United States Patent [19]

Largeteau

[11] Patent Number: 4,516,359

[45] Date of Patent: May 14, 1985

[54] GRINDING MACHINE

[75] Inventor: Pierre A. Largeteau, Bezons, France

[73] Assignees: S.A. Automobiles Citroen; Societe Automobiles Peugeot, both of Paris, France

[21] Appl. No.: 367,065

[22] Filed: Apr. 9, 1982

[30] Foreign Application Priority Data

Apr. 16, 1981 [FR] France ..... 81 08064

[51] Int. Cl.[3] ..... B24B 5/36

[52] U.S. Cl. ..... 51/349; 51/34 J

[58] Field of Search ..... 51/339, 349, 165.93, 51/355, 34 J

[56] References Cited

U.S. PATENT DOCUMENTS

| | | | |
|---|---|---|---|
| 2,781,616 | 2/1957 | Estabrook | 51/349 |
| 3,561,168 | 2/1971 | Robillard | 51/165.75 |
| 4,173,847 | 11/1979 | Gehring | 51/349 |

FOREIGN PATENT DOCUMENTS

| | | | |
|---|---|---|---|
| 2831681 | 2/1979 | Fed. Rep. of Germany | 51/339 |
| 3019998 | 12/1980 | Fed. Rep. of Germany | 51/349 |
| 2443901 | 8/1980 | France | 51/349 |

*Primary Examiner*—Harold D. Whitehead

*Attorney, Agent, or Firm*—Karl F. Ross; Herbert Dubno

[57] ABSTRACT

The present invention relates to a grinding machine comprising an expansion jack whose piston is connected to the expansion rod of a grinder, means for detecting the position of the piston of this jack and for supplying an electric signal as a function of this position, therefore of the expansion of the grinder, and means for comparing this signal with a reference value and for emitting, when this value is attained, a signal for stopping displacement of the piston, wherein said grinding machine comprises means for modifying the reference value in the event of wear of the grinder or shift in dimensions.

7 Claims, 2 Drawing Figures

GRINDING MACHINE

FIELD OF THE INVENTION

The present invention relates to grinding machines comprising an expansion jack whose piston is connected to the expansion rod of a grinding machine, means for detecting the position of the piston of this jack and for furnishing an electric signal as a function of this position and, therefore of the expansion of the grinder, and means for comparing this signal with a reference value and for emitting, when this value is attained, a signal for stopping the displacement of the piston.

BACKGROUND OF THE INVENTION

In grinding machines of this type, expansion of the grinder is automatically stopped as soon as the desired expansion is attained. However, experience has shown that the pieces ground with the aid of these machines may undergo variations in dimensions, either due wear and tear of the grinder or to a shift in dimensions of thermal or mechanical origin.

OBJECT OF THE INVENTION

It is an object of the present invention to provide an improved grinding machine which allows compensation of the wear of the grinder or a shift in dimensions.

SUMMARY OF THE INVENTION

This grinding machine of the invention is characterized in that it comprises means for modifying the reference value in case of wear and tear of the grinder or shift in dimensions.

In a particular embodiment of the invention, the means for modifying the reference value comprise an analog voltmeter with a threshold and means for varying the threshold of this voltmeter.

The means for varying the threshold of the voltmeter may comprise, for example, a digital upcounter-downcounter with manual display, a digital-to-analog converter interposed between the counter and the voltmeter, and means for modifying the display of the counter as a function of wear of the grinder or shift in dimensions.

The means for varying the threshold of the voltmeter may also comprise a step-by-step motor, a control screw which rotates with the shaft of this motor but is free in translation with respect thereto, and is mounted in a fixed nut, an electronic follower which is controlled by the screw and connected to the voltmeter, and means for rotating the shaft of the step-by-step motor as a function of wear of the grinder or shift in dimensions.

BRIEF DESCRIPTION OF THE DRAWING

The invention will be more readily understood on reading the following description with reference to the accompanying drawing, in which.

SPECIFIC DESCRIPTION

Figure 1:
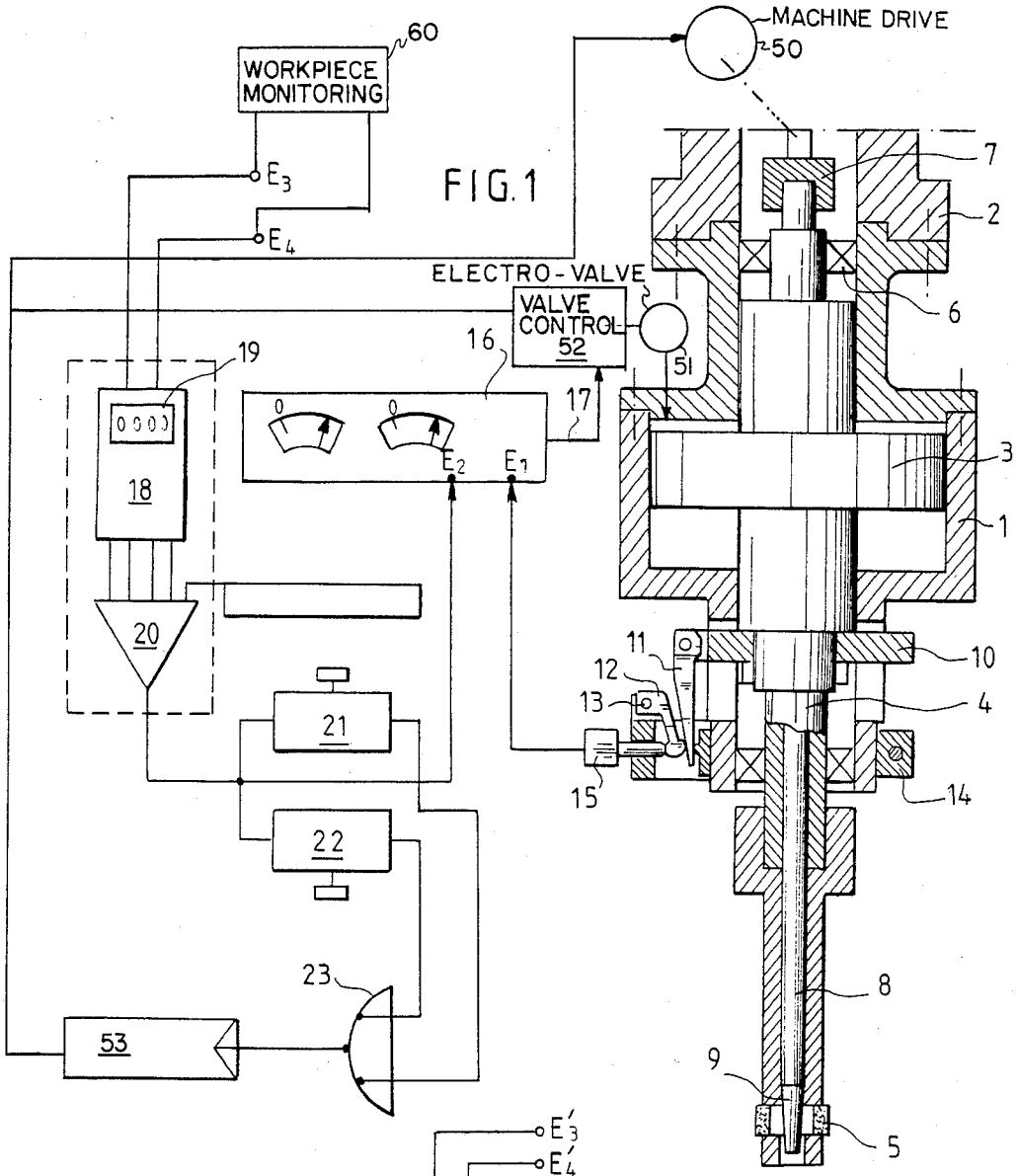
FIG. 1 is a diagram of a first embodiment.

Referring now to the drawings, FIG. 1 shows a grinding head comprising an expansion jack body 1 which is fixed to the piston 2 of a jack, only the lower end of which is shown. In body 1 is slidably mounted the piston 3 of the expansion jack traversed by a pin 4 whose lower part carries the grinder 5 and whose upper part is mounted in the body 1 via a bearing 6 and connected to the spindle 7 of the grinding machine. The pin 4 is itself traversed by an expansion rod 8 which bears the expansion cone 9 of the grinder 5 and which is connected with the piston 3 to enable axial displacement of the cone 9 in its grinder 5.

A bracket 10 fixed to the piston 3 of the expansion jack bears a control cam 11 which has the same profile as the expansion cone 9. An intermediate follower 12 is mounted to pivot at 13 on a support 14 fixed on the body 1. This follower bears a pad which abuts the cam 11 and on which abuts the sensitive element of an electronic follower 15 whose body is fixed to the support 14. The displacement of the piston 3 of the expansion jack 1 causes the follower 12 to pivot and actuate the follower 15, the latter thus furnishing a signal as a function of the displacement of the piston 3, and, therefore, of the expansion rod 8.

With the grinding machine is associated an electronic unit comprising a voltmeter 16 with two inputs $E_1$ and $E_2$. The input $E_1$ is connected to the follower 15, while input $E_2$ receives a variable signal which is added to the signal of the input $E_1$, and the sum is compared with the fixed threshold of the voltmeter, this indirectly modifying the reference of the voltmeter. When the signal received from the follower reaches the reference value, the voltmeter 16 emits at 17 an order (which may be a pulse or a closure of circuit, e.g. circuit 52) for cutting off supply of an electro-valve 51 supplying the cylinder 1.

The variable signal defining the reference value is furnished by a digital upcounter-downcounter 18 with manual or electrical display, on the dial 19 of which may be displayed the voltage to be applied at $E_2$. This counter 18 is connected to the input $E_2$ via a variable gain digital-to-analog converter 20.

The upcounter-downcounter 18 has two inputs $E_3$ and $E_4$. When a pulse is furnished at input $E_3$, the smallest decade of the counter, for example, is increased by one unit; when a pulse arrives at input $E_4$, the same decade is decreased by one unit.

The ground pieces are monitored. If the dimensions measured are within the tolerance, the piece is accepted; it is rejected if the tolerance is exceeded. If the measured mean dimensions of a series of pieces, while remaining within the tolerance, are shifted from the center of tolerance by an excessive value, for example one micron, a pulse is applied to input $E_3$ or to input $E_4$ depending on the direction of shift. This pulse may be automatically furnished by the piece monitoring apparatus 60.

In the embodiment shown, the continuous signal coming from the digital-to-analog converter 20 is furnished not only to input $E_2$, but also to two voltmeters 21 and 22 with maximum threshold and minimum threshold respectively. The voltmeter 21 is adjusted so as to furnish information when a maximum value corresponding to maximum admissible wear of the grinder is attained. The voltmeter 22 furnishes a pulse when a minimum value corresponding to the total deflation of the grinder is attained. The outputs of the voltmeters 21 and 22 are connected to the inputs of an OR gate 23 whose output is connected to a circuit 53 for closing the electro-valve supplying the cylinder 1 of the expansion jack and at the same time for stopping the machine drive 50.

Figure 2:
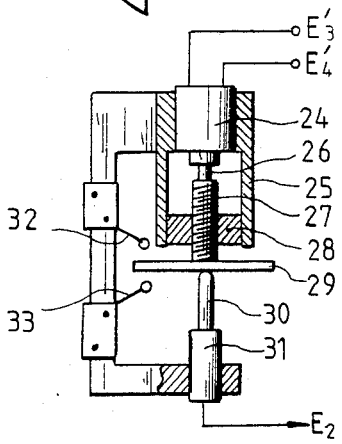
FIG. 2 schematically shows a detail of a second embodiment.

In the embodiment of FIG. 2, a step-by-step motor 24 is mounted in a fixed support 25. This motor comprises two inputs $E'_3$ and $E'_4$ which are supplied like inputs $E_3$ and $E_4$ and which are such that the arrival of a pulse causes the shaft 26 of the motor to pivot by one step in one direction if the pulse is received by input $E'_3$ and in the opposite direction if it is received by the input $E'_4$. A screw 27 rotates with the shaft 26, but is free in translation with respect to this shaft; to this end, the shaft 26 may for example be fast with a toothed wheel engaged in inner grooves in the screw 27. The latter is mounted in a fixed nut 28 and bears at its end a disc 29 on which abuts the tip 30 of an electronic follower 31; the latter is connected to the input $E_2$ which thus receives a signal as a function of the displacement of the disc 29.

The disc 29 is mobile between two contacts 32 and 33 which produce pulses when they are reached by the disc 29 and constitute contacts with maximum and minimum thresholds performing the same role as the voltmeters 21 and 22 with thresholds.

It goes without saying that the present invention must not be considered as limited to the embodiment described and shown but cover, on the contrary, all variants thereto.

What I claim is:

1. A grinding machine comprising:

an expandable grinding tool connected to a machine drive;

an expansion rod received in said tool and axially displaceable therein to expand said tool;

a fluid operated jack having a piston connected to said rod for axially displacing same;

means for continuously monitoring position of said piston for continuously generating an electrical signal as a function of this position and of expansion of said tool;

an analog voltmeter receiving said signal and having a variable threshold for outputting a control signal upon attain-ment of said threshold;

an electrovalve emergized by said control signal and connected to said jack for operating same to modify the expansion of said tool automatically to compensate for wear thereof; and means for automatically modifying said threshold upon wear of said tool and a change in dimensions of a product ground by the tool.

2. The grinding machine defined in claim 1 wherein said means for automatically modifying said threshold of said analog voltmeter comprising a digital up-down counter with manual display, a digital-to-analog converter connecting between said counter and said voltmeter, and means for modifying the display of said counter as a function of wear of said tool and change in dimensions.

3. The grinding machine defined in claim 2 wherein said analog voltmeter comprises a first voltmeter with a maximum threshold corresponding to complete wear of said tool and a second voltmeter having a minimum threshold corresponding to complete retraction of said tool, said voltmeters both being connected to the digital-to-analog converter and means connected to said voltmeters for stopping the machine drive when the threshold of one of said voltmeters is attained.

4. The grinding machine defined in claim 1 wherein the means for modifying said threshold of said voltmeter comprises a stepping motor, a control screw driven by the said motor but axially displaceable relative thereto, a fixed nut threadedly receiving said screw, an electronic follower responsive to the axial displacement of said screw and connected to said voltmeter, and means for driving said motor as a function of wear of said tool and change in dimensions.

5. The grinding machine defined in claim 4 wherein said stepping motor has a first input adapted to rotate the motor through one step in one direction when a pulse is received at said first input, and a second input adapted to rotate the motor by one step in the opposite direction when a pulse is received at said second input.

6. The grinding machine defined in claim 1 or 2, comprising a disc fixed at said screw, respective contacts disposed on opposite sides of said disc and adapted to be actuated thereby when the axial displacement of said disc in either direction has reached given values, and means controlled by these contacts for stopping the machine.

7. The grinding machine defined in claim 1, claim 2 or claim 3 wherein the means for detecting the position of said piston comprises a cam fixed at said piston, and a follower having a sensitive element engaging said cam and mounted on said jack.

* * * * *